US008052392B1

(12) United States Patent
Liang

(10) Patent No.: US 8,052,392 B1
(45) Date of Patent: Nov. 8, 2011

(54) PROCESS FOR COOLING A TURBINE BLADE TRAILING EDGE

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 0 days.

(21) Appl. No.: 13/177,847

(22) Filed: Jul. 7, 2011

Related U.S. Application Data

(62) Division of application No. 12/335,424, filed on Dec. 15, 2008, now Pat. No. 7,985,050.

(51) Int. Cl.
*F01D 5/08* (2006.01)

(52) U.S. Cl. ..... 416/97 R; 416/96 R

(58) Field of Classification Search ..... 416/1, 96 R, 416/97 R; 415/115
See application file for complete search history.

(56) References Cited

U.S. PATENT DOCUMENTS 4,293,275 A * 10/1981 Kobayashi et al. ..... 416/97 R
4,526,512 A * 7/1985 Hook ..... 416/96 A
4,669,957 A * 6/1987 Phillips et al. ..... 416/97 R
5,405,242 A * 4/1995 Auxier et al. ..... 415/115
6,379,118 B2 * 4/2002 Lutum et al. ..... 416/97 R
6,932,573 B2 * 8/2005 Liang ..... 416/97 R
6,955,525 B2 * 10/2005 Liang ..... 416/97 R
6,981,846 B2 * 1/2006 Liang ..... 416/97 R
7,097,417 B2 * 8/2006 Liang ..... 415/115

* cited by examiner

*Primary Examiner* — Kiesha Bryant
*Assistant Examiner* — Mark Tornow
(74) *Attorney, Agent, or Firm* — John Ryznic

(57) ABSTRACT

A turbine airfoil with a trailing edge cooling circuit that includes a row of pressure side bleed channels connected to a metering and impingement cooling circuit that discharges a layer of film cooling air out through a row of exit slots that open onto a pressure side wall of the trailing edge to provide cooling for the trailing edge region of the airfoil. Formed within the trailing edge tip is a vortex flow chamber extending the length of the airfoil and connected to the bleed channels by a row of inlet holes to draw a portion of the film cooling air into the vortex chamber to provide cooling for the trailing edge tip and to prevent the film cooling layer from breaking off from the pressure side wall. The vortex chamber is connected to a row of exit holes offset from the inlet holes to form the vortex flow and to discharge the vortex flowing cooling air out the trailing edge in a direction parallel to the suction side wall.

5 Claims, 4 Drawing Sheets

PROCESS FOR COOLING A TURBINE BLADE TRAILING EDGE

CROSS-REFERENCE TO RELATED APPLICATIONS

This application is a DIVISIONAL application of U.S. patent application Ser. No. 12/335,424 filed on Dec. 15, 2008 and entitled TURBINE BLADE WITH TRAILING EDGE COOLING.

FEDERAL RESEARCH STATEMENT

None.

BACKGROUND OF THE INVENTION

1. Field of the Invention

The present invention relates generally to a gas turbine engine, and more specifically to an air cooled turbine airfoil with trailing edge cooling.

2. Description of the Related Art Including Information Disclosed Under 37 CFR 1.97 and 1.98

A gas turbine engine includes a turbine section with multiple rows or stages or stator vanes interposed with rotor blades that react with a hot gas flow passing through the turbine. One process for increasing an efficiency of the turbine, and thus the engine, is to pass a higher temperature gas flow into the turbine (referred to at the turbine inlet temperature, or TIT). However, exposing the turbine airfoils to higher temperatures requires improved materials or better cooling.

The trailing edge region of an airfoil, such as a turbine rotor blade, is exposed to some of the highest gas flow temperatures. Also, the trailing edge of the airfoil is thin in order to prevent the flow from separating downstream. FIG. 1 shows a prior art turbine blade with a trailing edge cooling circuit in which pin fins extend across a trailing edge cooling channel. This design for trailing edge cooling requires a relatively thick airfoil at the trailing edge to accommodate the pin fins. In some turbine stage blades, this large trailing edge thickness may induce high blockage and thus reduce the stage performance.

Size and space limitations make the trailing edge region of a gas turbine airfoil one of the most difficult areas to cool. In particular for a high temperature turbine airfoil cooling design, extensive trailing edge cooling is required. FIG. 2 shows another prior art turbine blade which is sued in a first stage of the turbine, and makes use of a pressure side bleed for the airfoil trailing edge cooling. This type of cooling design used to minimize the airfoil trailing edge thickness has been used for airfoil trailing edge cooling for the last 30 years. Problems associated with this type of cooling is the shear mixing between the cooling air and the mainstream hot gas flow as the cooling air exits from the pressure side. The shear mixing of the cooling air with the mainstream flow reduces the cooling effectiveness for the trailing edge overhang and thus induces an over-temperature at the airfoil trailing edge suction side location. Frequently, this over-temperature location becomes the life limiting location for the entire airfoil.

Cooling air exit slots have been used on the pressure side of the trailing edge region of an airfoil, but are long in the chordwise direction of the airfoil. Thin long length discharges the cooling air but does not provide enough cooling for the trailing edge tip. Thus, a metal over-temperature occurs on the trailing edge due to a lack of adequate cooling.

BRIEF SUMMARY OF THE INVENTION

It is an object of the present invention to provide for a turbine airfoil with adequate cooling of the trailing edge tip.

It is another object of the present invention to provide for a relatively shorter pressure side exit slot along the trailing edge region that will not discharge the cooling air and disrupt the film layer.

The present invention is a turbine airfoil, such as a rotor blade or a stator vane, with a row of exit cooling holes that discharge cooling air out through pressure side slots on the trailing edge region, and a vortex chamber extending along the airfoil trailing edge to form a vortex cooling air flow for cooling of the trailing edge tip. The vortex chamber includes a row of cooling air inlet holes that open onto the pressure side surface of the airfoil at a location downstream from the exit slots so that cooling air from the exit slots is sucked into the vortex chamber. The vortex chamber also includes a row of discharge holes located at the trailing edge tip toward the suction side that discharges the cooing air from the vortex chamber in a direction parallel to the hot gas flow over the suction side wall of the trailing edge region. The inlet holes are offset from the outlet holes in order to promote the vortex flow within the chamber.

DETAILED DESCRIPTION OF THE INVENTION

Figure 1:
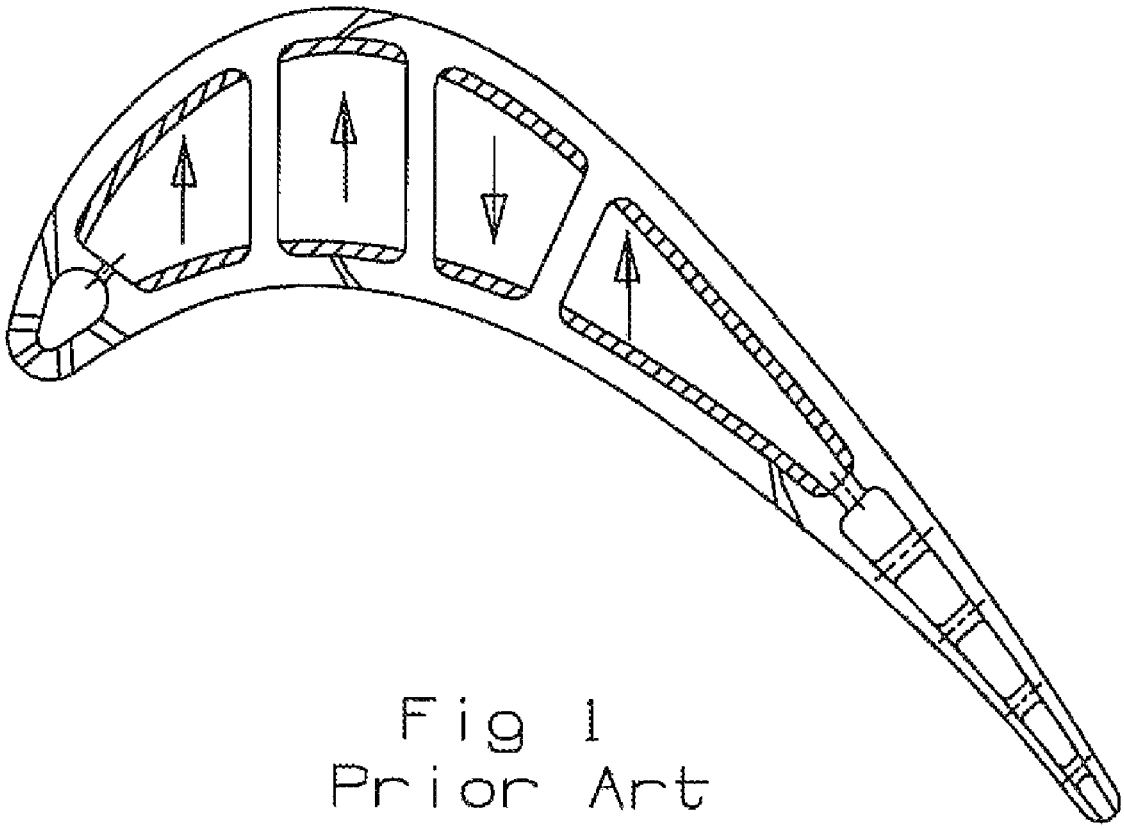
Fig 1 Prior Art
FIG. 1 shows a cross section view of a prior art turbine blade with trailing edge cooling pin fins.
Figure 2:
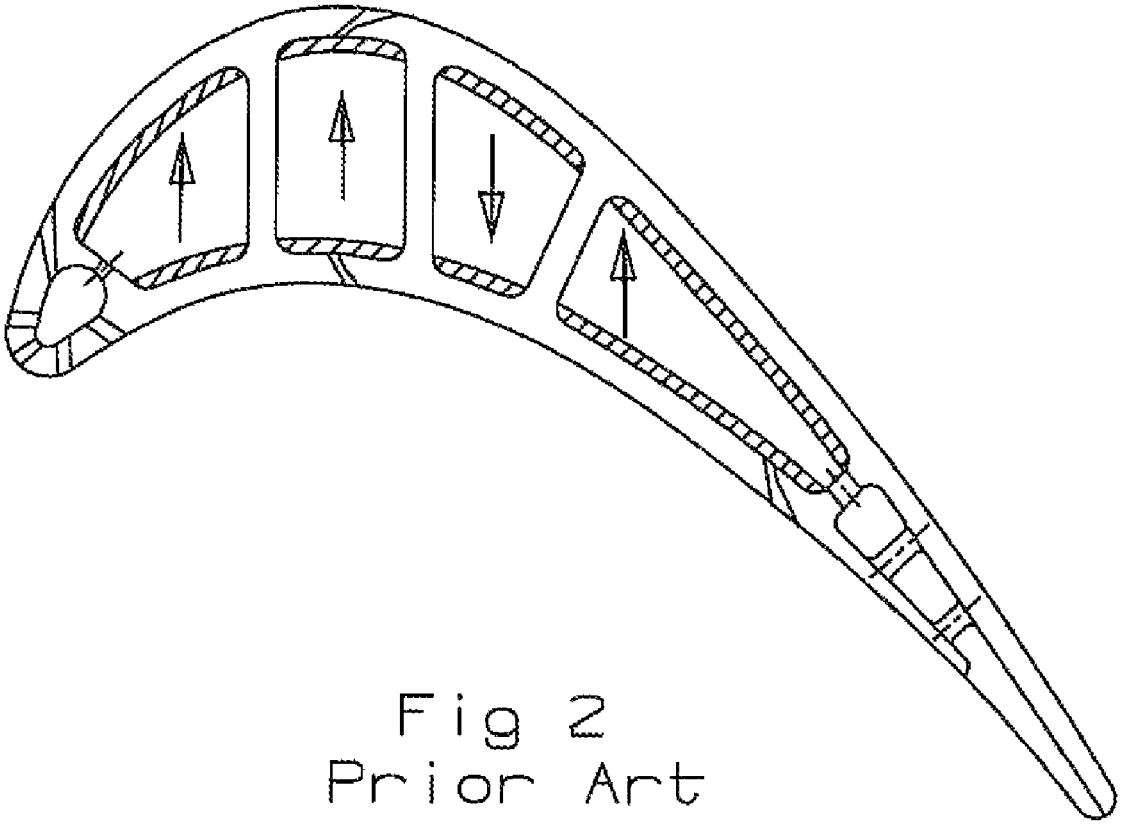
Fig 2 Prior Art
FIG. 2 shows a cross section view of another prior art turbine blade with pin fins and pressure side exit slots.
Figure 3:
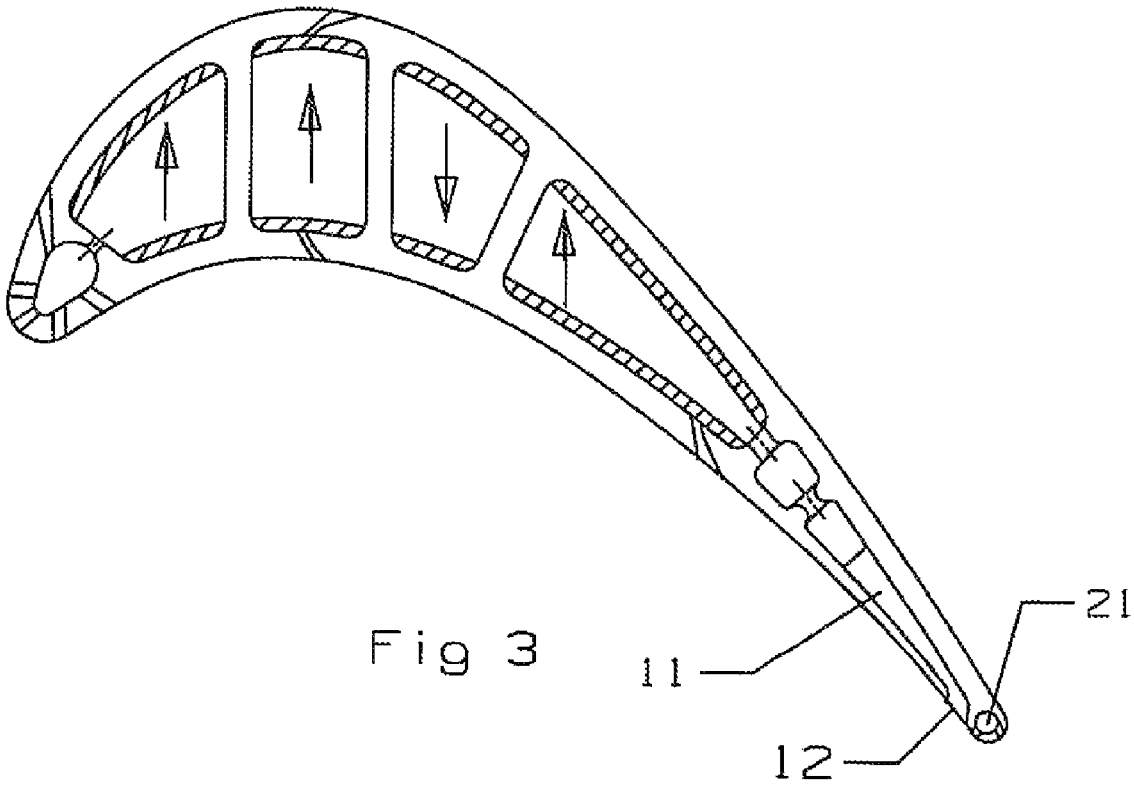
FIG. 3 shows a turbine blade with the trailing edge cooling circuit of the present invention.

FIG. 3 shows a turbine rotor blade with a cooling circuit having a leading edge cooling circuit to cool the leading edge region and a serpentine flow cooling circuit to provide cooling for the mid-chord region. The trailing edge region is cooled by rows of double impingement cooling passages with exit slots that open onto the pressure side surface of the trailing edge region. To allow for a shorter exit slot on the pressure side, the present invention provides for a vortex chamber formed at the trailing edge tip with a row of inlet holes to suck in cooling air from the cooling air exiting the slots, and includes a row of exit holes to discharge the cooling air from the vortex chamber. This design allows for the shorter exit slots (shorted in the chordwise direction of the airfoil) while providing for adequate cooling of the trailing edge.

Figure 4:
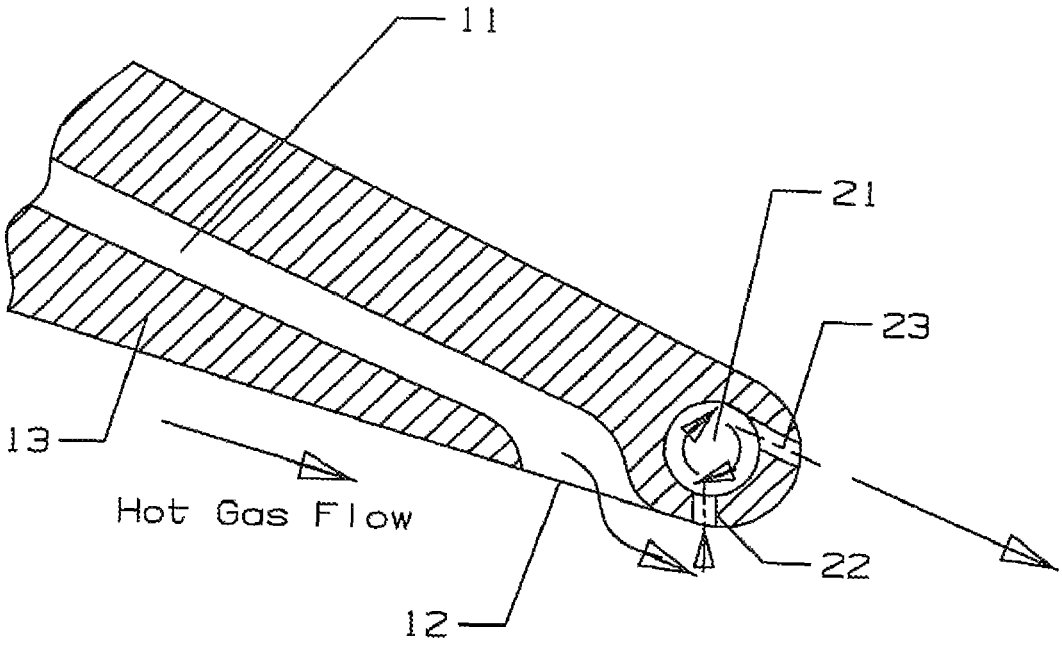
FIG. 4 shows a detailed view of the trailing edge cooling circuit of the present invention.

Details of the vortex chamber is shown in FIG. 4 and includes the pressure side bleed channel 11 that discharges the cooling air from the internal cooling circuit, a shortened exit slot 12 formed by a pressure side lip of the upstream side of the slot 12 and a outwardly curved edge 14 on the opposite side. The trailing edge region of the airfoil includes a row of these bleed channels and exit slots 12 to provide cooling for the trailing edge region of the airfoil. Each bleed channel 11 includes one exit slot 12.

A vortex chamber 21 is formed in the airfoil along the trailing edge tip and extends the length of the airfoil where the bleed channels and exit slots extend. The vortex chamber 21 includes a row of inlet holes 22 that open onto the pressure side wall of the airfoil downstream from the exit slot and function to suck in the cooling air that is discharged from the slots 12. One or more inlet holes 22 are associated with each exit slot 12. The inlet holes 22 open into the vortex chamber to form a clockwise flow. A row of exit holes 23 are also connected to the vortex chamber 21 to discharge the cooling air from the vortex chamber 21 as seen in FIG. 4. The exit holes open into the vortex chamber on the suction wall side of the vortex chamber as seen in FIG. 4. The exit holes 23 open onto the trailing edge tip on the suction side portion and are aligned with the suction side wall. The inlet holes 22 are offset from the exit holes 23 in order to promote a vortex flow within the vortex chamber. A vortex flow increases the heat transfer coefficient of the cooling air flow.

As the cooling air passes through the trailing edge cooling circuit, it is discharged through one or more metering and impingement holes in the row of bleed channels arranged along the airfoil in the trailing edge region to provide cooling at this region. The cooling air then flows along the bleed channels 11 and is discharged out through the pressure side exit slots 12 to form a layer of film air that flows over the pressure side wall of the trailing edge. The inlet holes 22 then suck in a portion of the higher pressure film layer into the vortex chamber to form a vortex flow of cooling air to provide cooling for the trailing edge tip. The vortex flow cooling air then discharges out through the exit holes to merge with the hot gas flow passing over the suction side wall. The vortex chamber also keeps the film layer of cooling air that is discharged from the exit slots 12 from breaking away from the airfoil surface. This increases the cooling effectiveness of the film layer and also increases the efficiency of the airfoil.

The trailing edge vortex chamber cooling circuit of the present invention can be used in a turbine rotor blade or a stator vane to provide cooling of the trailing edge tip. The vortex chamber 21 can be formed within the airfoil during the casting process that forms the entire airfoil along with the inlet and exit holes. Or, the inlet and exit holes can be drilled or formed into the airfoil after the vortex chamber has been cast. An EDM process or a laser process can be used to form the holes in the vortex chamber 21.

I claim the following:

1. A process for cooling a trailing edge of a turbine airfoil comprising the steps of:

passing cooling air through a mid-chord region of the airfoil;

metering cooling air from the mid-chord region through the trailing edge region;

discharging a layer of film cooling air onto a pressure side surface of the trailing edge of the airfoil;

drawing in a portion of the film cooling air inside the airfoil to cool a trailing edge tip of the airfoil; and, discharging the drawn in cooling air out the trailing edge of the airfoil.

2. The process for cooling a trailing edge of a turbine airfoil of claim 1, and further comprising the step of:

forming a vortex flow with the drawn in air to increase the heat transfer from the metal to the cooling air.

3. The process for cooling a trailing edge of a turbine airfoil of claim 2, and further comprising the step of:

discharging the vortex flowing cooling air out the trailing edge in a direction parallel to the suction side wall of the airfoil.

4. The process for cooling a trailing edge of a turbine airfoil of claim 1, and further comprising the step of:

the step of drawing in the cooling air includes sucking in a boundary layer to prevent the film layer from breaking away from the pressure side wall of the airfoil at the trailing edge.

5. The process for cooling a trailing edge of a turbine airfoil of claim 2, and further comprising the step of:

discharging the layer of film cooling air at a high enough pressure to cause a portion of the cooling air to be drawn into the trailing edge vortex flow.

* * * * *